US010590768B2

(12) United States Patent
Giger

(10) Patent No.: US 10,590,768 B2
(45) Date of Patent: Mar. 17, 2020

(54) ENGINE CRANK AND CONNECTING ROD MECHANISM

(71) Applicant: Anton Giger, Great Falls, MT (US)

(72) Inventor: Anton Giger, Great Falls, MT (US)

( * ) Notice: Subject to any disclaimer, the term of this patent is extended or adjusted under 35 U.S.C. 154(b) by 0 days.

(21) Appl. No.: 16/531,113

(22) Filed: Aug. 4, 2019

(65) Prior Publication Data

US 2019/0390551 A1 Dec. 26, 2019

Related U.S. Application Data

(63) Continuation of application No. 16/010,440, filed on Jun. 16, 2018, now Pat. No. 10,370,970.

(51) Int. Cl.

| | |
|---|---|
| ***F01B 9/04*** | (2006.01) |
| ***F02B 75/28*** | (2006.01) |
| ***F02B 75/32*** | (2006.01) |
| ***F01B 7/14*** | (2006.01) |
| ***F02F 7/00*** | (2006.01) |

(52) U.S. Cl.

CPC ..... *F01B 9/042* (2013.01); *F02B 75/28* (2013.01); *F02B 75/32* (2013.01); *F01B 7/14* (2013.01); *F01B 2009/045* (2013.01); *F02F 7/0009* (2013.01)

(58) Field of Classification Search

CPC ..... F01B 9/042; F01B 7/14; F01B 2009/045; F02B 75/28; F02B 75/32; F02F 7/0009

See application file for complete search history.

(56) References Cited

U.S. PATENT DOCUMENTS

| | | | | |
|---|---|---|---|---|
| 5,067,456 | A * | 11/1991 | Beachley | F02B 41/04 123/197.4 |
| 5,755,195 | A * | 5/1998 | Dawson | F02B 41/04 123/197.4 |
| 7,559,298 | B2 * | 7/2009 | Cleeves | F01L 5/06 123/188.5 |
| 2002/0185101 | A1 * | 12/2002 | Shaw | F02B 75/32 123/197.4 |
| 2012/0037130 | A1 * | 2/2012 | Fuqua | F01B 7/08 123/51 R |
| 2016/0290452 | A1 * | 10/2016 | Ransil | F16H 19/043 |

* cited by examiner

*Primary Examiner* — Joseph J Dallo
*Assistant Examiner* — Kurt Philip Liethen
(74) *Attorney, Agent, or Firm* — Harvey Lunenfeld

(57) ABSTRACT

A crank and connecting rod mechanism having an angularly disposed connecting rod and mirror image gear sets, each comprising: a crank gear rotatably mounted on a crank gear shaft, having a crankpin pivotally connected to and driven by the connecting rod, the crankpin following the path of a roulette of a centered trochoid about a first stationary gear as the crank gear is driven about the first stationary gear and a crankshaft driven gear is driven about a second stationary gear, a counterbalanced radial arm affixed to a drive shaft at a pivot point of the counterbalanced radial arm, the counterbalanced radial arm driving the drive shaft at the pivot point and the crank gear shaft at an outer radial arm bearing, the drive shaft driving a drive shaft gear, which drives an output gear that drives an output shaft.

24 Claims, 10 Drawing Sheets

ENGINE CRANK AND CONNECTING ROD MECHANISM

This application is a continuation of U.S. patent application Ser. No. 16/010,440, filed Jun. 16, 2018, the full disclosure of which is incorporated herein by reference. The above referenced document is not admitted to be prior art with respect to the present invention by its mention herein.

BACKGROUND OF THE INVENTION

1. Field of the Invention

The present invention relates generally to internal combustion engines and more particularly to internal combustion engine crank and connecting rod mechanisms.

2. Background Art

The internal combustion engine had its beginnings circa 1680, when Christian Huygens, the Dutch physicist, experimented with an internal combustion engine. Later, the first continuously acting gasoline powered engine was built and operated circa 1859, when the French engineer J. J. Étienne Lenoir built a double acting spark ignition engine. Since that time, attempts have been made to improve power output and efficiency, yet performance improvements are still necessary.

James Atkinson developed a variant of the four stroke Otto cycle in 1882 called the Atkinson Cycle, the first implementation of which was constructed as an opposed piston engine, the Atkinson differential engine.

Oechelhäuser constructed a 600 horsepower two-stroke opposed piston engine, which was installed at the Hoerde ironworks circa 1898, and manufactured by German manufacturer Deutsche Kraftgas Gesellschaft, William Beardmore & Sons Ltd of the UK, and other companies from 1899.

Smaller versions of the opposed piston engine were developed by Gobron-Brillié, a French company circa 1900, and in 1904 a motor vehicle driven by Louis Rigolly and powered by an opposed piston engine, was the first motor vehicle to exceed one hundred miles per hour.

Opposed piston engines have advantages over other types of engines, and provide significant fuel, weight, and volume efficiency benefits. Such engines were used to power automobiles, ships, aircraft, and other equipment, since the early 1900's.

Most internal combustion engines operate at relatively low power levels at slow acceleration, low speed, and/or light load. Conventional gasoline engines and today's opposed piston engines, typically operate at fixed compression ratios, which are set low enough to prevent premature ignition of the fuel and so called "knock" at high power levels, which typically occurs at fast acceleration, high speed, and/or heavy load.

Opposed piston engines have evolved over the last century to the present day and, to this day, although opposed piston engines typically offer more power per liter of engine displacement than other internal combustion engines, improvements in performance, power output and efficiency are still required.

Most current internal combustion engines, including opposed piston engines, used in automobiles, typically are four stroke engines, which have pistons, each of which has an intake stroke, a compression stroke, a power stroke, and an exhaust stroke, which are used to turn the engine's crankshaft.

The intake stroke typically begins at top dead center (T.D.C.) and ends at bottom dead center (B.D.C.). The intake valve is typically in the open position, while the piston pulls an air-fuel mixture into the cylinder by producing vacuum pressure in the cylinder through its downward motion.

The compression stroke typically begins at bottom dead center (B.D.C), or just at the end of the intake stroke, and ends at top dead center (T.D.C). The piston compresses the air-fuel mixture in preparation for ignition during the power stroke. Both the intake and exhaust valves are closed during this stage.

While the piston is at top dead center (T.D.C.) (typically at the end of the compression stroke), the compressed air-fuel mixture is ignited by a spark plug (in a gasoline engine) or by heat generated by high compression (in a diesel engine), forcefully returning the piston to bottom dead center (B.D.C). The power stroke produces mechanical work from the engine to turn the crankshaft. The power stroke typically starts at the beginning of the second revolution of the four stroke cycle, the crankshaft typically having completed a first revolution at this point.

During the exhaust stroke, the piston again returns from bottom dead center (B.D.C.) to top dead center (T.D.C.), while the exhaust valve is open, and expels the spent air-fuel mixture through the exhaust valve, at the end of which the four stroke cycle completes a second revolution, and the crankshaft typically completes a second revolution.

The engine's crankshaft, connecting rods, and pistons and their geometry play a significant role in engine performance and efficiency.

The distance the piston moves from one end to the other end of its cylinder is the stroke (S) of the piston. The rod to stroke ratio (R/S) is the center-to-center length (R) of the connecting rod divided by the stroke (S). The rod to stroke ratio (R/S) and the location of the crankpin determine the motion characteristics of the piston and, thus, the performance and efficiency of the engine.

Improvements in internal combustion engine performance, power, and efficiency are necessary. Such improvements can be achieved by improving the motion characteristics of the pistons within such engines, including those of conventional engines and opposed piston engines.

Improvements in the geometry of the engine's crankshaft, connecting rods, and pistons play a significant role in the motion characteristics of the pistons within such engines, and can result in significant improvements in engine performance, power, and efficiency.

Although improvements in internal combustion engine performance, power, and efficiency can be accomplished by improving the engine's crankshaft, connecting rods, and pistons and, consequently, the motion characteristics of the pistons within such engines, improvements are still required.

Different internal combustion engines, including opposed piston engines, have heretofore been known. However, none of the engines having modified engine crankshaft, connecting rod, and piston enhancements adequately satisfies these aforementioned needs.

U.S. Pat. No. 7,021,270 (Stanczyk) discloses a connecting rod and crankshaft assembly for an engine, having a crankshaft that is offset from a centerline of the bore shaft of a reciprocally sliding piston. A curved or angularly shaped connecting rod is pivotally connected to the piston at one end and to the crankshaft at the opposite end. The position of the crankshaft and the shape of the connecting rod maximize the travel of the connecting rod through the piston stroke in relation to the overall size of the connecting rod. The design permits maximum compression to be achieved after the top dead center of the crankshaft to further promote engine efficiency.

U.S. Pat. No. 5,146,884 (Merkel) discloses an engine with an offset crankshaft. When the crankshaft is rotated in a clockwise direction, the distance the piston travels from the top of the stroke (piston at maximum travel) to the bottom of the stroke (piston at the bottom of its travel) is greater than the diameter of the crankshaft rotation. The angle through which the crankshaft moves during the downstroke is greater than 180 degrees. The engine therefore has a longer time power stroke than exhaust stroke. The intake cycle is longer in time than the exhaust cycle which improves aspiration of the engine. This concept can be applied to Otto cycle engines, Diesel engines, two stroke engines, and may be applied to compressors. When used in compressors, the intake stroke is extended which improves aspiration.

U.S. Pat. No. 6,460,505 (Quaglino, Jr.) discloses an offset connecting rod for use with internal combustion engines, in which a rod with a central longitudinal axis connects each of the pistons at a first end of the rod to a crankshaft at the second end of each of the rod; the connection point between the second end of each of the rods to the crankshaft is offset from the longitudinal axis sufficiently to increase engine torque and horsepower, as each of the pistons travel within their respective cylinders, but not to affect the engine stroke.

U.S. Pat. No. 7,891,334 (O'Leary) discloses a four-cycle internal combustion engine comprising a variable length connecting rod, two crank gears, and two drive gears; the first end of the connecting rod is connected to a piston; the second end of the connecting rod is connected to a yoke assembly comprising two arms, a first connecting shaft, and two second connecting shafts; the first connecting shaft connects the second end of the connecting rod to each of the yoke arms; the second end of the connecting rod and the yoke arms rotate freely about the first connecting shaft; each crank gear comprises an off-center hole; the second connecting shafts connect the yoke arms to the off-center hole of each crank gear; the yoke arms and the crank gear rotate freely about the second connecting shaft; and each crank gear is driven by a drive gear.

U.S. Pat. No. 4,876,992 (Sobotowski) discloses a variable compression ratio engine that has a pair of crankshafts connected by a phase adjuster mechanism operative to change the phase angle between the crankshafts, so as to vary the compression ratio of the engine. The phase adjuster mechanism includes two pairs of helical phasing gears. Each of those pairs consists of a gear fixedly mounted on a crankshaft and, operatively engaged therewith, a wider gear fixedly mounted on an axially movable adjuster member. The crankshafts can be arranged in-line or side-by-side in parallel. Each of the phasing gears, which is fixedly connected to the axially movable adjuster member, is bounded by a respective imaginary cylindrical surface whose axis coincides with and whose points are equidistant from the axis of rotation of the adjuster member, and whose diameter is equal to the outside diameter of that phasing gear, and which extends along the length of the engine block without intersecting the envelope swept by each crankshaft and connecting rod means associated with that crankshaft, whereby the phasing gears of the phase adjuster mechanism are operable along the entire length of the engine block, so as to minimize the length of each of the crankshafts and, ultimately, the external lengthwise dimensions of the engine.

U.S. Pat. No. 7,185,557 (Venettozzi) discloses an epitrochoidal crankshaft mechanism and method for enhancing the performance of both two stroke and four stroke cycle reciprocating piston internal combustion engines, reciprocating piston pumps and compressors by generating an Epitrochoidal path of travel for the lower end of a connecting rod. A piston, attached to the upper end of the connecting rod, dwells at the lower portion of travel, enhancing the output of the engine, pump or compressor through better utilization of the available cylinder pressure.

U.S. Pat. No. 8,967,097 (Perez, et al.) discloses a variable stroke mechanism for varying the stroke length of an internal combustion engine, during each cycle of operation that includes a gear set with a first gear non-rotatably mounted to the engine block and a second gear having teeth formed on an inner surface thereof meshing with the first gear to achieve a uniform mechanical crank arm and a variable cam arm for producing a varying length of piston reciprocation throughout the overall stroke cycle of the engine. The orientation of the crank arm and the cam arm relative to the axis of piston reciprocation is selected for causing the crank arm and the cam arm to cooperatively produce a positive torque on the crankshaft at the top dead center position of the piston. The gear set is also selectively configured and dimensioned to achieve a predetermined ratio of the length of the cam arm to the length of the crank arm.

U.S. Pat. No. 5,816,201 (Garvin) discloses an offset crankshaft mechanism for an internal combustion engine, which allows for greater efficiency and increased torque. The invention includes an engine block, a crankcase, one or more piston cylinders, each having a piston reciprocally disposed therein, a rotatable crankshaft longitudinally disposed within the crankcase and offset at a predetermined distance from the vertical axis of the piston cylinder, and one or more connecting rods connecting the pistons to the crankshaft. The offset crankshaft is located, such that at a point during the power stroke the crankshaft is perpendicular to the vertical axis of the piston cylinder and the connecting rod is substantially collinear with the vertical axis of the piston cylinder. The crankshaft must be located far enough below the piston cylinders to prevent interference between the connecting rods and the piston cylinders. Long connecting rods are used to increase the efficiency of the engine, by increasing the combustion chamber pressure at top dead center and reducing the return stroke angle, which reduces the friction between the pistons and the piston cylinders.

U.S. Pat. No. 5,215,051 (Smith) discloses a modified aspirated internal combustion engine, in which a crankshaft is eccentrically mounted to the engine block bearings of an internal combustion engine for providing improved volumetric efficiency. A modified crankshaft journal and engine block bearing structure is provided at each crankshaft support location, so that the connecting rod bearings rotate about an eccentric centerline. Eccentricity is achieved by off-setting the crankshaft journals a predetermined distance above the original true centerline of the crankshaft, preferably on the order of about one-quarter to one-half inch. The top dead center (TDC) of each piston remains the same relative to its cylinder, but the bottom dead center (BDC) of each piston relative to its cylinder is lowered by the amount of the off-set, because the engine block bearings are lowered with respect to the true centerline of the crankshaft by the amount of the off-set on the crankshaft journals.

U.S. Pat. No. 7,438,041 (Renato) discloses an eccentric connecting rod system, in which a piston pin is shaped like a cylinder and has two cuts disposed orthogonally to the axis of the piston pin, which form three sectors. Two external sectors correspond to the connection with the crank, and an internal sector is coupled to the connecting rod.

U.S. Pat. No. 6,505,582 (Moteki, et al.) discloses a variable compression ratio mechanism of a reciprocating engine that includes at least an upper link connected at one end to a piston pin and a lower link connecting the other end of the upper link to a crankpin. At top dead center, when hypothetical connecting points between the upper and lower links are able to be supposed on both sides of the line segment connecting the piston-pin center and the crankpin center, and the first one of the connecting points has a smaller inclination angle, measured in the same direction as a direction of rotation of the crankshaft, from the axial line of reciprocating motion of the piston-pin center and to a line segment connecting the piston-pin center and the first connecting point; as compared to the second connecting point, the first connecting point is selected as the actual connecting point.

For the foregoing reasons, there is a need for improved internal combustion engines, including opposed piston engines, having improved performance, power, and efficiency under different load, speed, and environmental conditions. Such engines should have improvements in the geometry of the engines' crankshaft, connecting rods, and pistons, which result in improvements in the motion characteristics of the pistons within such engines and, consequently, improvements in engine performance, power, and efficiency, under a variety of load, speed, and environmental conditions.

SUMMARY

The present invention is directed to improvements in engine performance, power, and efficiency that can be achieved by modifying the motion and travel characteristics of the connecting rods of an internal combustion engine.

The connecting rods in conventional internal combustion engines have composite motion, i.e., the small ends of the connecting rods reciprocate, and the large ends of the connecting rods rotate. The small ends of the connecting rods are connected to the pistons with floating cylindrical pins, called wrist pins. The large ends of the connecting rods, which oppose the small ends of the connecting rods, are typically connected to the crankshaft of a typical conventional internal combustion engine by a crankpin.

Improvements in the motion and travel characteristics of the connecting rods are used to modify and improve the motion and travel characteristics of the pistons that result in improved engine performance, power, and efficiency, using crank and connecting rod mechanisms of the present invention.

A crank and connecting rod mechanism having features of the present invention for use in an opposed piston engine, comprises: opposed pistons, which reciprocate within opposed cylinders, each having a cylinder bore, comprising: opposed connecting rods, each connecting rod of the opposed connecting rods having: a first leg and a second leg angularly disposed from one another, the first leg having a piston end, each piston of the opposed pistons pivotally connected to a the piston end, the second leg having a crank end; opposed pairs of gear sets, each pair of gear sets of the opposed pairs of gear sets comprising a first gear set and a second gear set, which are mirror images of each other, each gear set of the each pair of gear sets comprising: a crankpin; the crank end of the second leg pivotally connected to the crankpin; the crankpin extending between the crank gear of the first gear set and the crank gear of the second gear set; a crank gear, a crank gear shaft, the crank gear rotatably mounted on the crank gear shaft, the crankpin located between the centerline of the crank gear shaft and the radius of the pitch circle of the crank gear; a first stationary gear, the crank gear meshing with the first stationary gear, the crank end of the connecting rod driving the crankpin, which drives the crank gear and the crank gear shaft about the first stationary gear, the crank pin and the crank end rotating about the first stationary gear and following the path of a roulette of a centered trochoid about the first stationary gear; a crankshaft driven gear, the crankshaft driven gear rotatably mounted on the crank gear shaft, the crank gear and the crankshaft driven gear mounted on opposing ends of the crank gear shaft; a second stationary gear opposing the first stationary gear, the crankshaft driven gear meshing with the second stationary gear; a drive shaft, the drive shaft rotatably mounted to the first stationary gear; the drive shaft rotatably mounted to the second stationary gear; a counterbalanced radial arm, the counterbalanced radial arm having a pivot point and an outer radial arm bearing, the counterbalanced radial arm between the crank gear and the crankshaft driven gear and between the first stationary gear and the secondary stationary gear, the counterbalanced radial arm affixed to the drive shaft at the pivot point, the counterbalanced radial arm rotatably mounted to the crank gear shaft at the outer radial arm bearing, the crank gear shaft driving, at the outer radial arm bearing, the counterbalanced radial arm about the pivot point, the crankshaft driven gear rotating about the second stationary gear substantially in unison with the crank gear rotating about the first stationary gear; the counterbalanced radial arm rotatably driving the drive shaft about the pivot point; a drive shaft gear, the drive shaft gear affixed to the drive shaft the drive shaft driving the drive shaft gear; an output gear, the drive shaft gear driving the output gear; an output shaft, the output shaft affixed to the output gear of the each gear set of the each pair of gear sets, the output gear affixed to the output shaft.

An alternate embodiment of a crank and connecting rod mechanism having features of the present invention for use in an internal combustion engine, comprises: a plurality of pistons, which reciprocate within a plurality of cylinders, each having a cylinder bore, comprising: a plurality of connecting rods, each connecting rod of the plurality of connecting rods having a piston end and a crank end: each piston of the plurality of pistons pivotally connected to a the piston end; a plurality of opposed pairs of gear sets, each pair of gear sets of the opposed pairs of gear sets comprising a first gear set and a second gear set, which are mirror images of each other, each gear set of the each pair of gear sets comprising: a crankpin; the crank end of the connecting rod pivotally connected to the crankpin; the crankpin extending between the crank gear of the first gear set and the crank gear of the second gear set; a crank gear, a crank gear shaft, the crank gear rotatably mounted on the crank gear shaft, the crankpin located between the centerline of the crank gear shaft and the radius of the pitch circle of the crank gear; a first stationary gear, the crank gear meshing with the first stationary gear, the crank end of the connecting rod driving the crankpin, which drives the crank gear and the crank gear shaft about the first stationary gear, the crank pin and the crank end rotating about the first stationary gear and following the path of a roulette of a centered trochoid about the first stationary gear; a crankshaft driven gear, the crankshaft driven gear rotatably mounted on the crank gear shaft, the crank gear and the crankshaft driven gear mounted on opposing ends of the crank gear shaft; a second stationary gear opposing the first stationary gear, the crankshaft driven gear meshing with the second stationary gear; a drive shaft, the drive shaft rotatably mounted to the first stationary gear; the drive shaft rotatably mounted to the second stationary gear; a counterbalanced radial arm, the counterbalanced radial arm having a pivot point and an outer radial arm bearing, the counterbalanced radial arm affixed to the drive shaft at the pivot point, the counterbalanced radial arm rotatably mounted to the crank gear shaft at the outer radial arm bearing, the crank gear shaft driving, at the outer radial arm bearing, the counterbalanced radial arm about the pivot point, the crankshaft driven gear rotating about the second stationary gear substantially in unison with the crank gear rotating about the first stationary gear; the counterbalanced radial arm rotatably driving the drive shaft about the pivot point; a drive shaft gear, the drive shaft gear affixed to the drive shaft the drive shaft driving the drive shaft gear; an output gear, the drive shaft gear driving the output gear; an output shaft, the output shaft affixed to the output gear of the each gear set of the each pair of gear sets, the output gear affixed to the output shaft.

Another alternate embodiment of a crank and connecting rod mechanism having features of the present invention for use in an internal combustion engine, comprises: at least one piston, which reciprocates within at least one cylinder, each the at least one cylinder having a cylinder bore, comprising: at least one connecting rod, each the at least one connecting rod having: a piston end and a crank end, each piston of the at least one piston pivotally connected to a the piston end; at least one opposed pair of gear sets, each the at least one opposed pair of gear sets comprising a first gear set and a second gear set, which are mirror images of each other, each gear set of the at least one pair of gear sets comprising: a crankpin; the crank end of the at least one connecting rod pivotally connected to the crankpin; the crankpin extending between the crank gear of the first gear set and the crank gear of the second gear set; a crank gear, a crank gear shaft, the crank gear rotatably mounted on the crank gear shaft, the crankpin located between the centerline of the crank gear shaft and the radius of the pitch circle of the crank gear; a first stationary gear, the crank gear meshing with the first stationary gear, the crank end of the at least one connecting rod driving the crankpin, which drives the crank gear and the crank gear shaft about the first stationary gear, the crank pin and the crank end rotating about the first stationary gear and following the path of a roulette of a centered trochoid about the first stationary gear; a crankshaft driven gear, the crankshaft driven gear rotatably mounted on the crank gear shaft, the crank gear and the crankshaft driven gear mounted on opposing ends of the crank gear shaft; a second stationary gear opposing the first stationary gear, the crankshaft driven gear meshing with the second stationary gear; a drive shaft, the drive shaft rotatably mounted to the first stationary gear; the drive shaft rotatably mounted to the second stationary gear; a counterbalanced radial arm, the counterbalanced radial arm having a pivot point and an outer radial arm bearing, the counterbalanced radial arm between the crank gear and the crankshaft driven gear and between the first stationary gear and the secondary stationary gear, the counterbalanced radial arm affixed to the drive shaft at the pivot point, the counterbalanced radial arm rotatably mounted to the crank gear shaft at the outer radial arm bearing, the crank gear shaft driving, at the outer radial arm bearing, the counterbalanced radial arm about the pivot point, the crankshaft driven gear rotating about the second stationary gear substantially in unison with the crank gear rotating about the first stationary gear; the counterbalanced radial arm rotatably driving the drive shaft about the pivot point; a drive shaft gear, the drive shaft gear affixed to the drive shaft the drive shaft driving the drive shaft gear; an output gear, the drive shaft gear driving the output gear; an output shaft, the output shaft affixed to the output gear of the each gear set of the each pair of gear sets, the output gear affixed to the output shaft.

DRAWINGS

These and other features, aspects, and advantages of the present invention will become better understood with regard to the following description, appended claims, and accompanying drawings where:

DESCRIPTION

Figure 1:
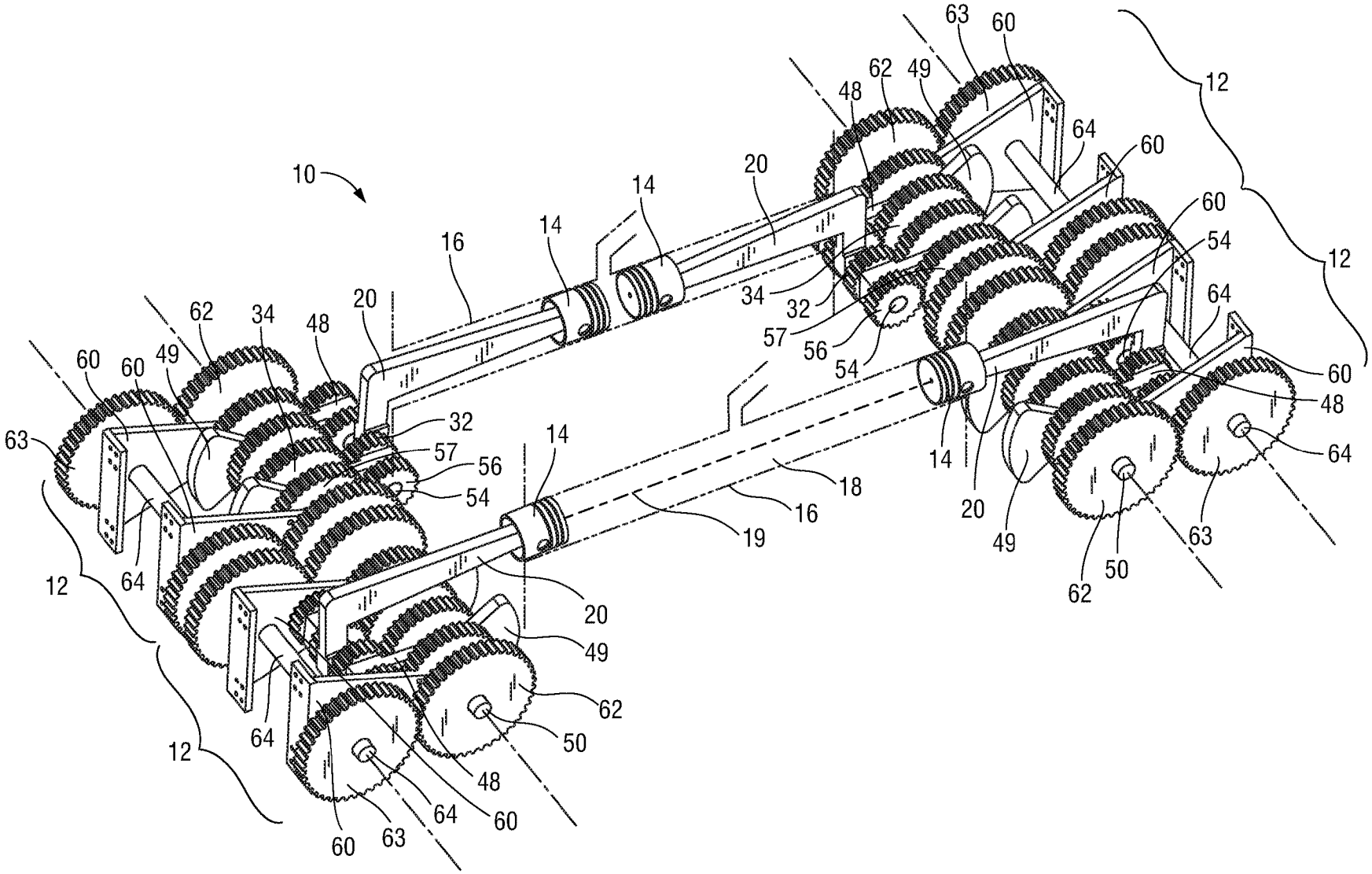
FIG. 1 is a perspective view of an interior portion of an opposed piston engine, showing opposed crank and connecting rod mechanisms of the present invention, constructed in accordance with the present invention.
Figure 2:
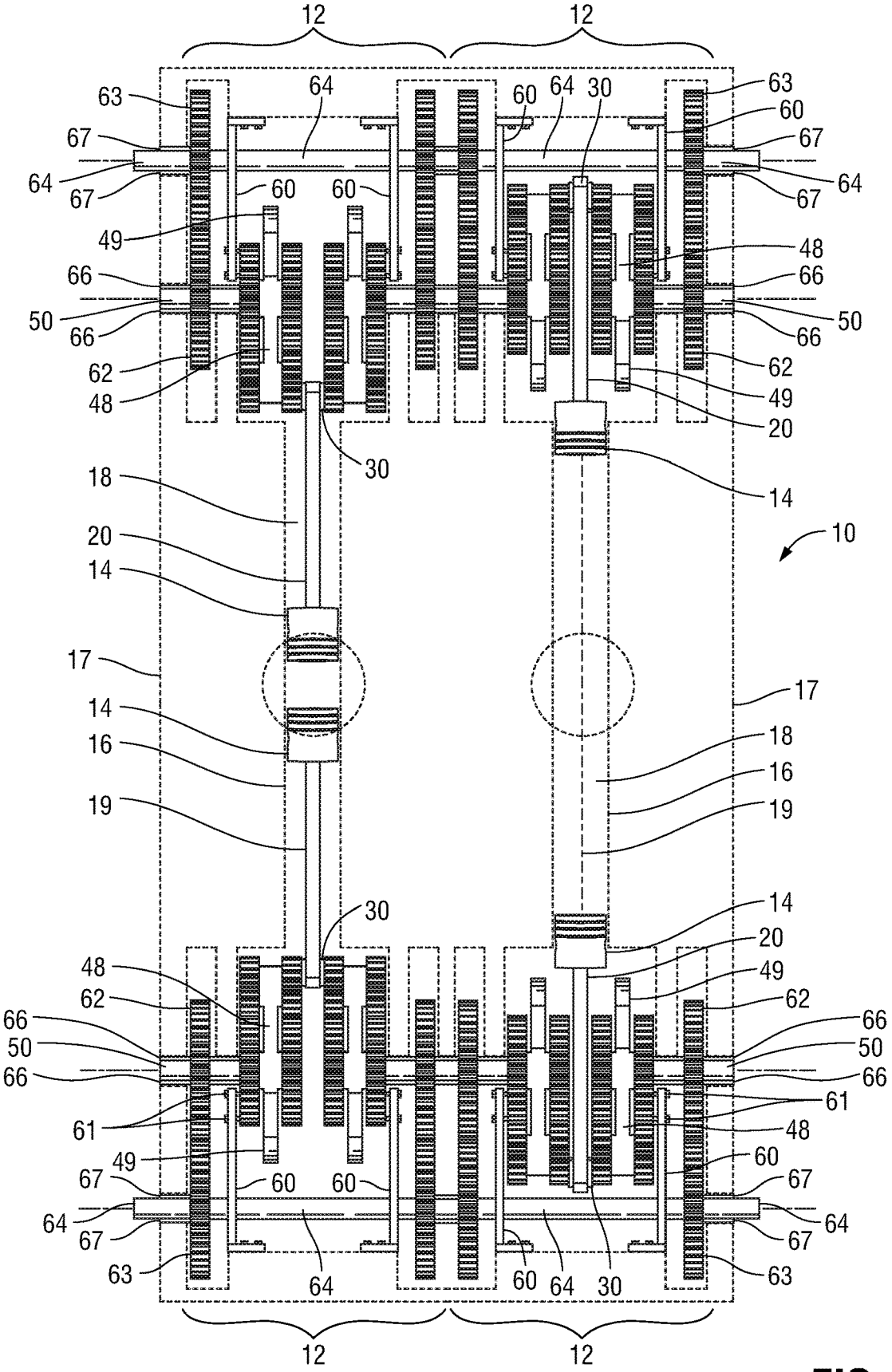
FIG. 2 is a top view of the interior portion of the opposed piston engine of FIG. 1, showing the opposed crank and connecting rod mechanisms of the present invention.
Figure 3:
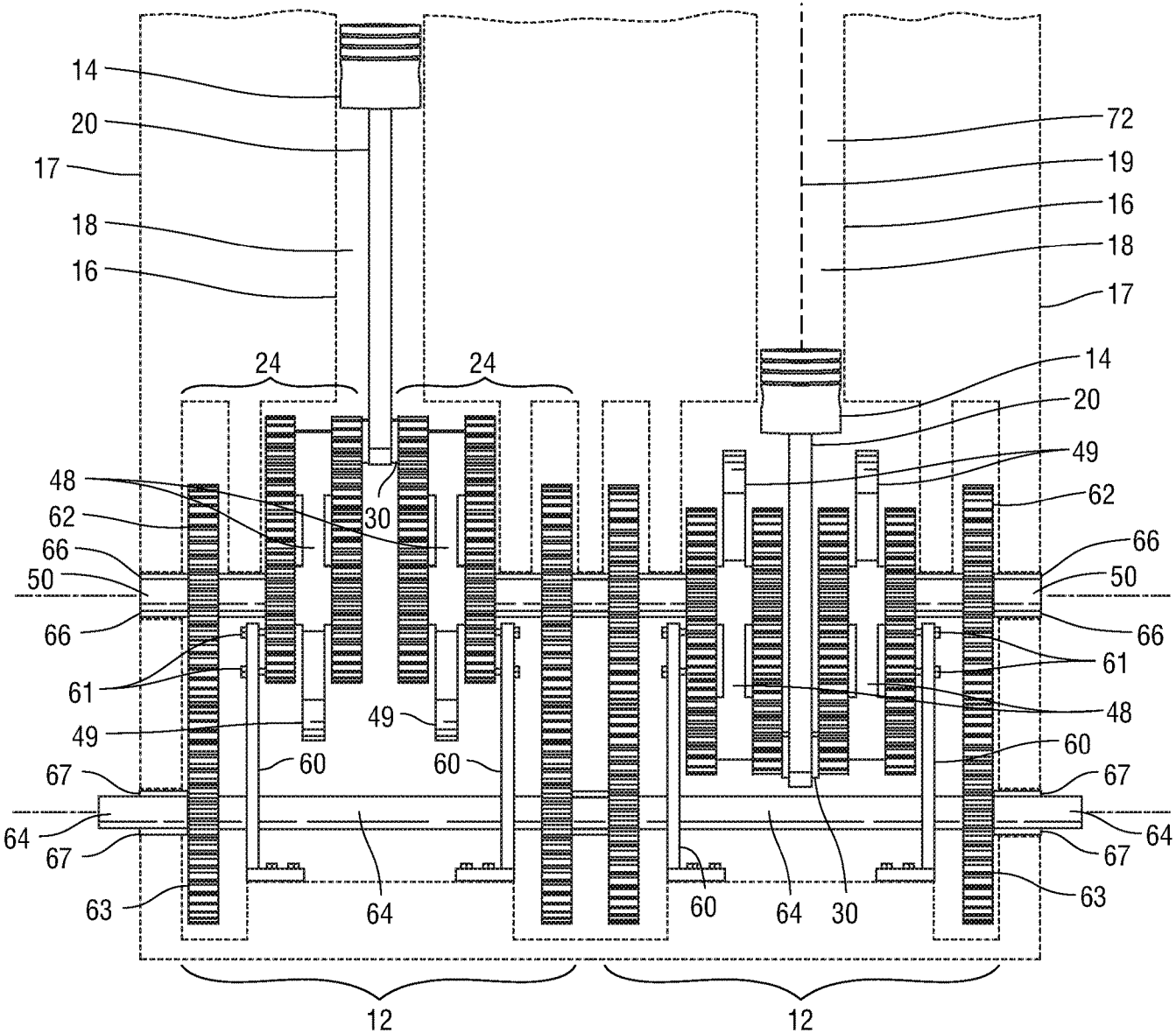
FIG. 3 is an enlarged portion of the top view of FIG. 2, showing adjacent ones of the opposed crank and connecting rod mechanisms.
Figure 4:
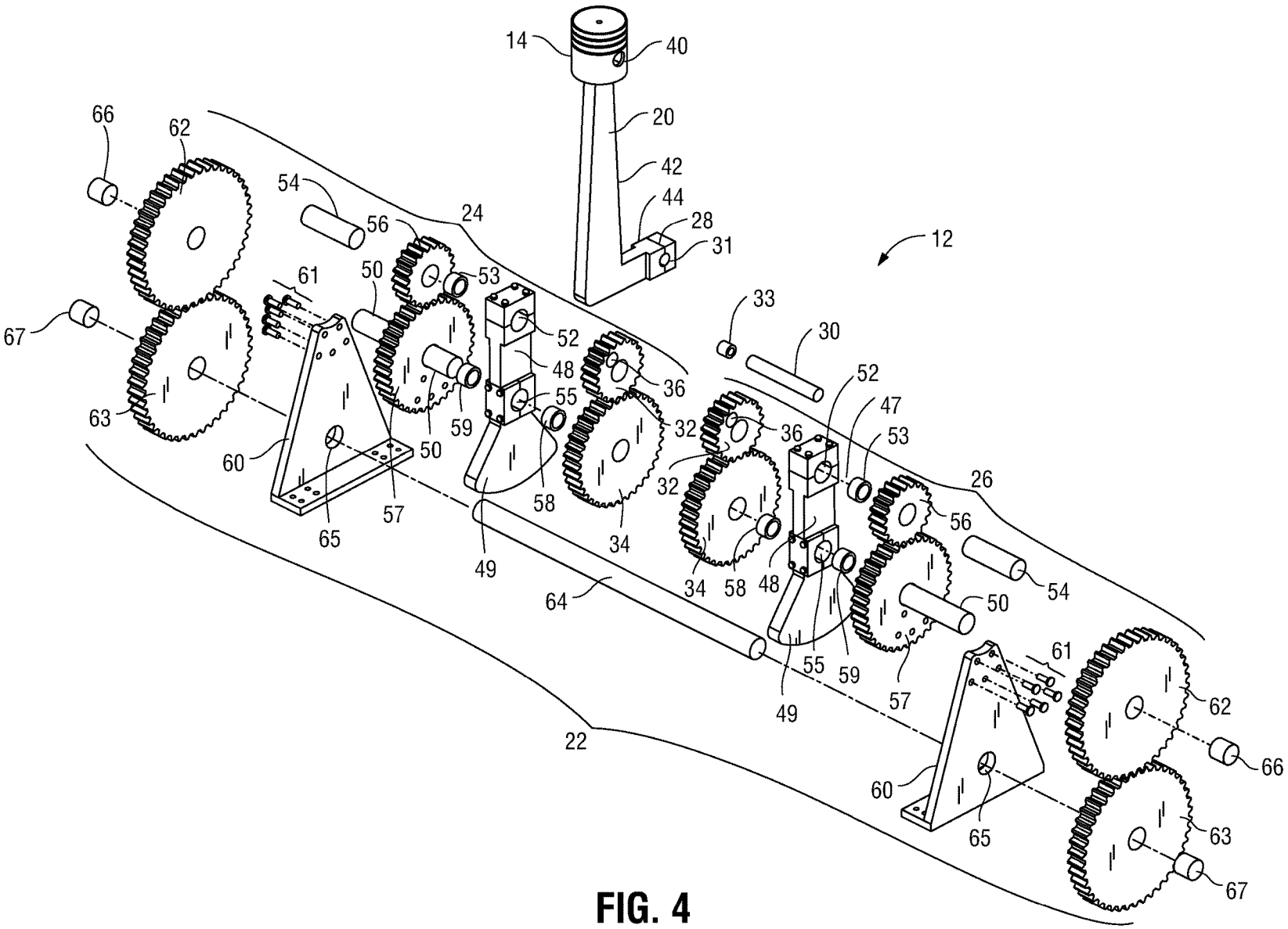
FIG. 4 is an exploded perspective view of one of the opposed crank and connecting rod mechanisms of FIG. 1.
Figure 5:
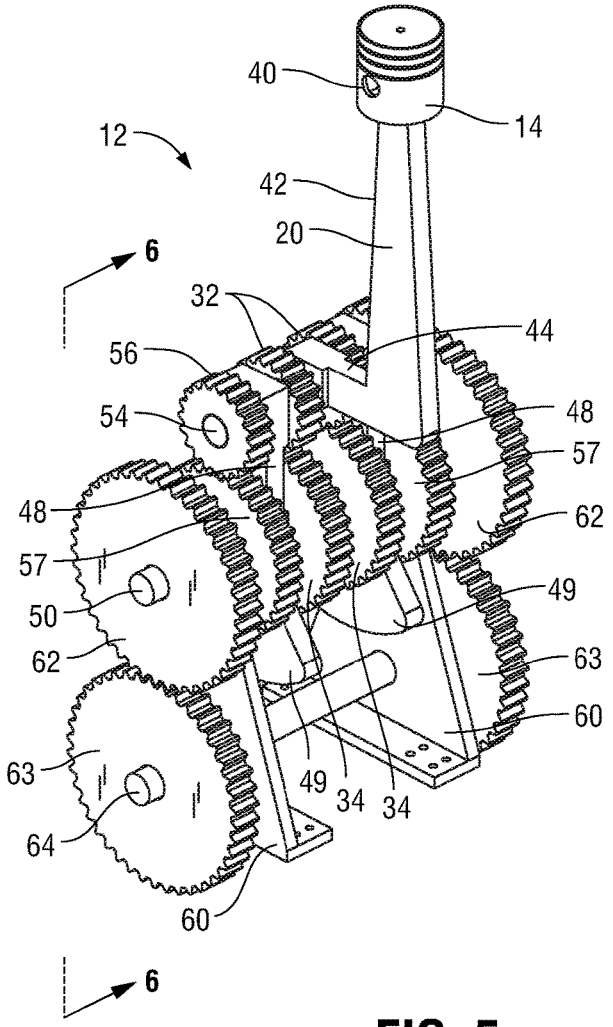
FIG. 5 is a perspective view of one of the opposed crank and connecting rod mechanisms of FIG. 1.
Figure 6:
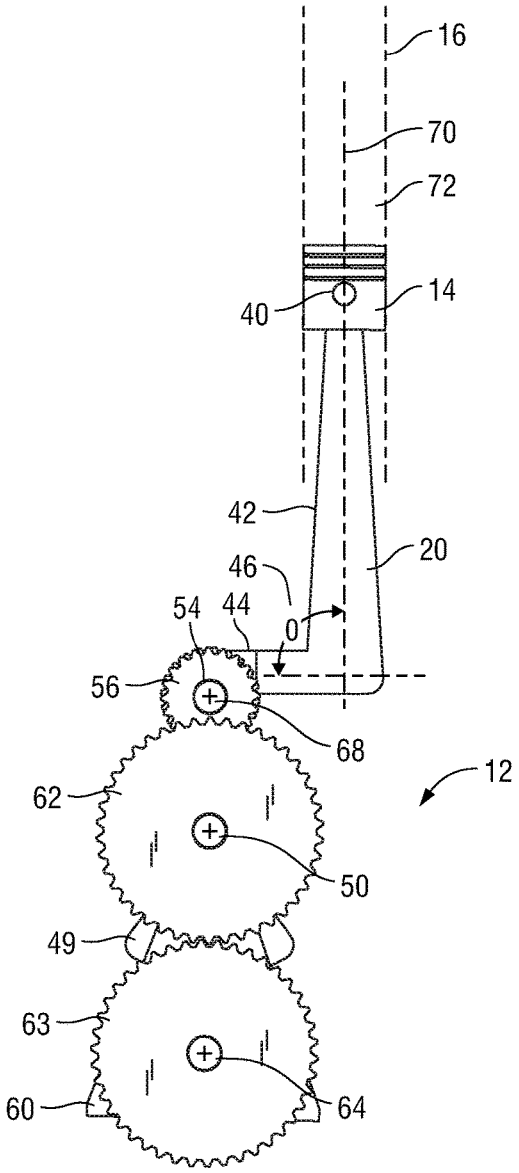
FIG. 6 is a side view of the crank and connecting rod mechanism of FIG. 5.
Figure 7:
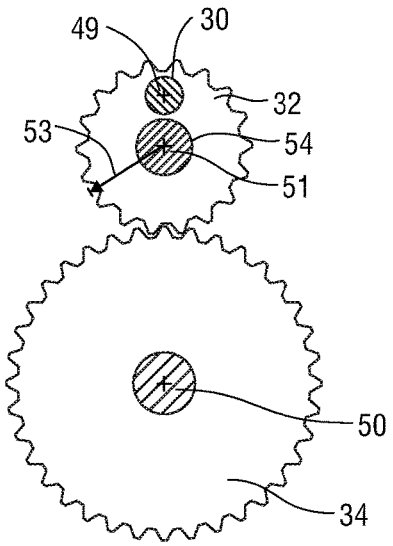
FIG. 7 is a side view of a crank gear and a first driven gear of the crank and connecting rod mechanism of FIG. 5.
Figure 8:
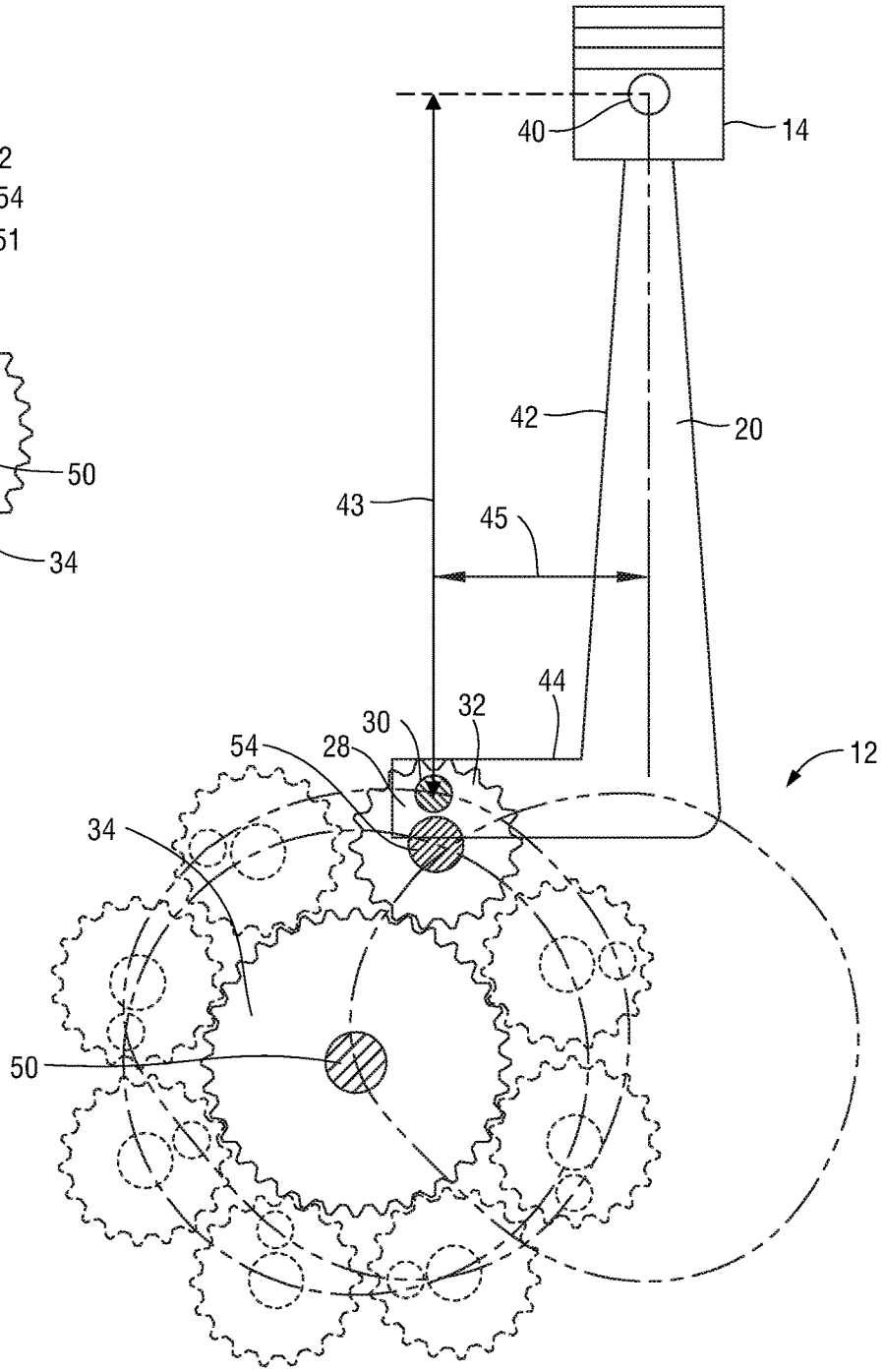
FIG. 8 is a side view of a connecting rod, the crank gear, and the first driven gear of the crank and connecting rod mechanism of FIG. 5, showing the crank gear and the first driven gear in different positions in phantom.
Figure 9:
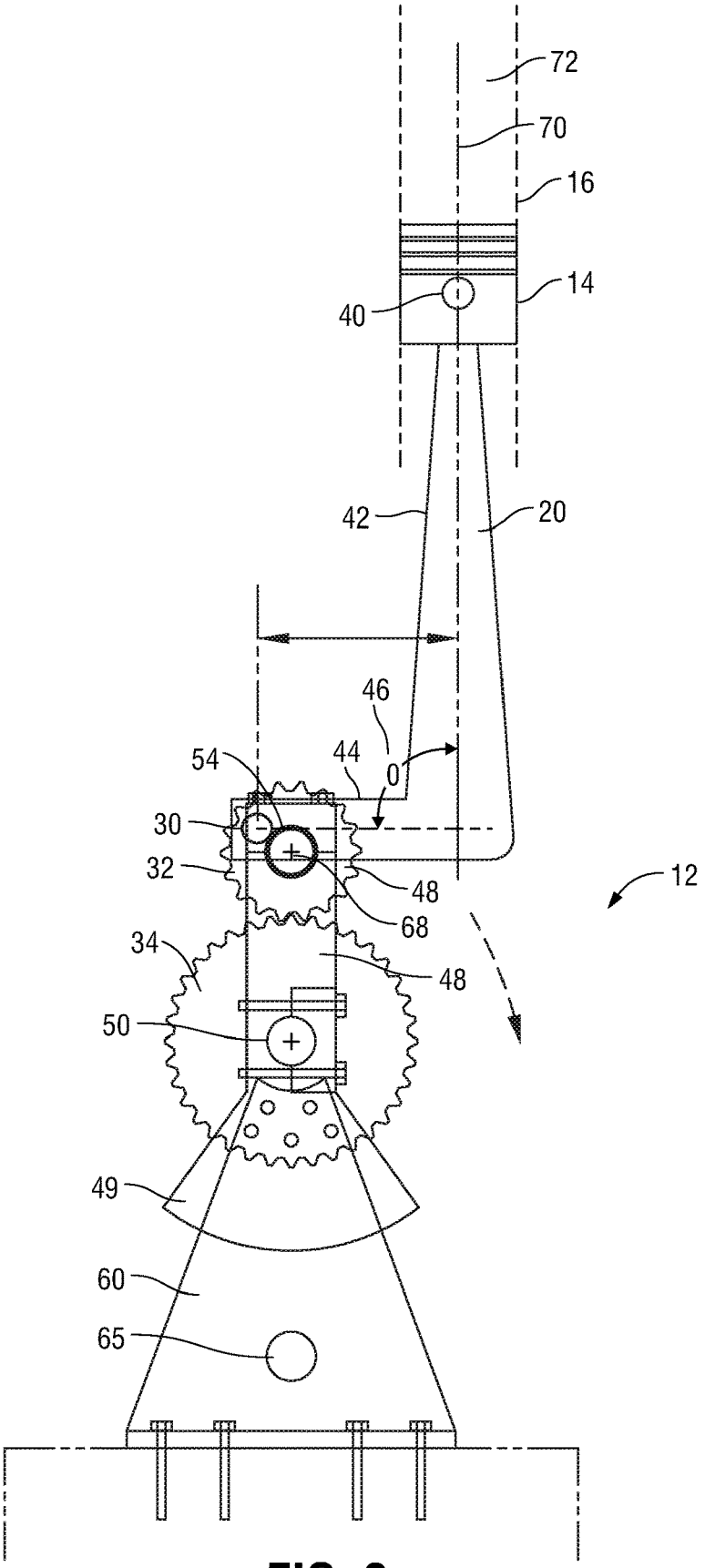
FIG. 9 is a partial side view of the crank and connecting rod mechanism of FIG. 5, showing the connecting rod and the crank gear in a first position.
Figure 10:
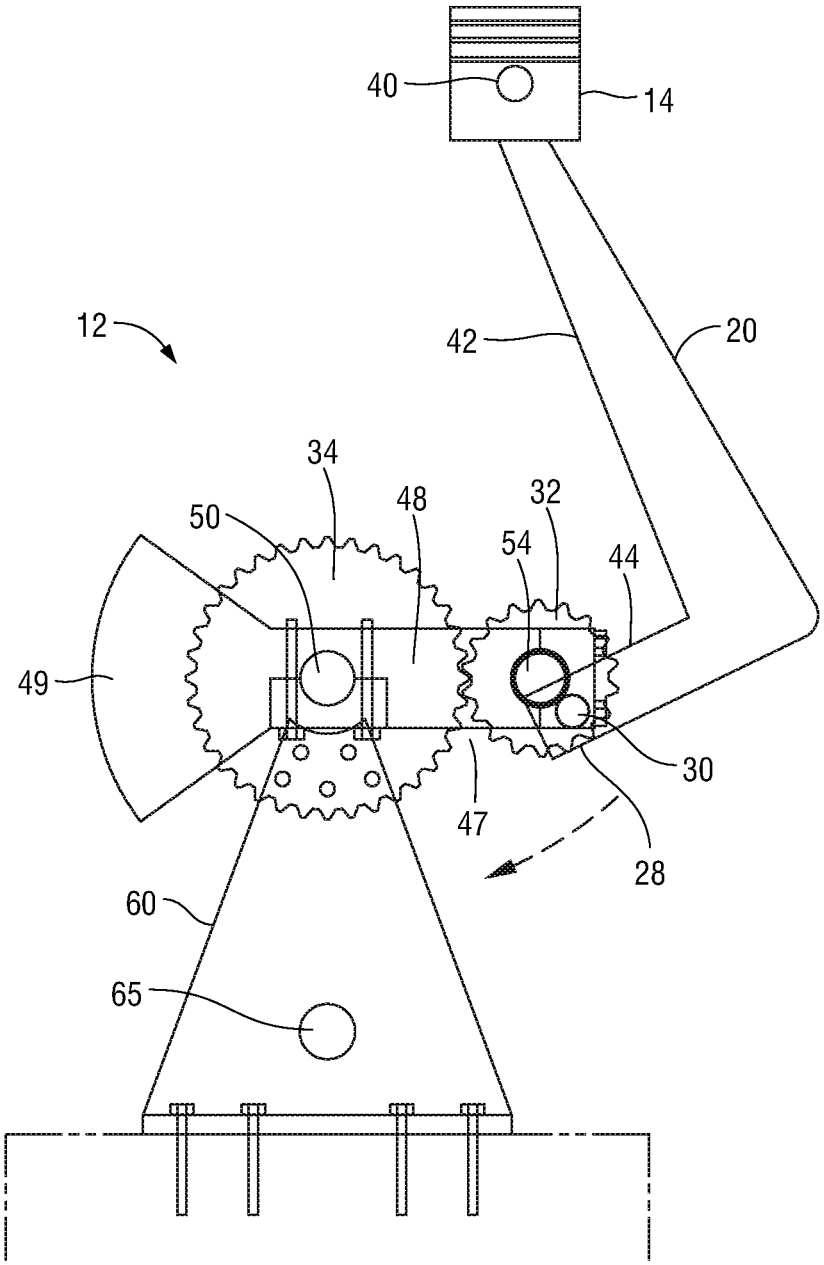
FIG. 10 is a partial side view of the crank and connecting rod mechanism of FIG. 5, showing the connecting rod and the crank gear in a second position.
Figure 11:
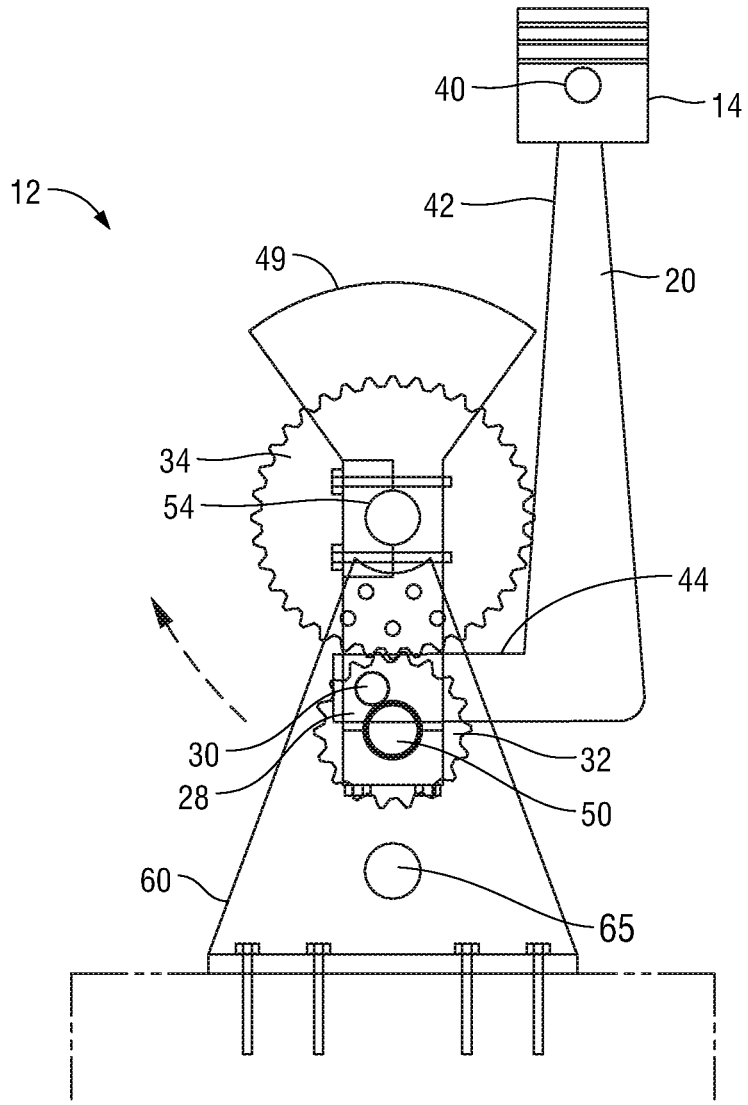
FIG. 11 is a partial side view of the crank and connecting rod mechanism of FIG. 5, showing the connecting rod and the crank gear in a third position.
Figure 12:
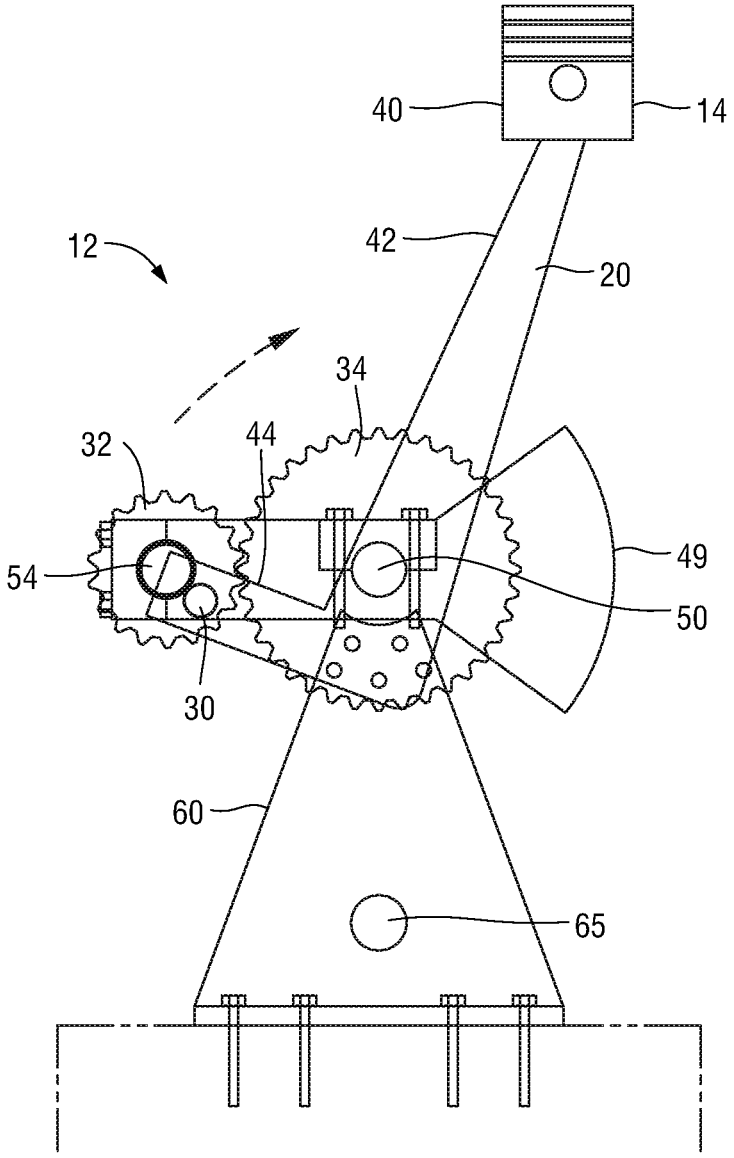
FIG. 12 is a partial side view of the crank and connecting rod mechanism of FIG. 5, showing the connecting rod and the crank gear in a fourth position.

The preferred embodiments of the present invention will be described with reference to FIGS. 1-12 of the drawings. Identical elements in the various figures are identified with the same reference numbers.

Improvements in engine performance, power, and efficiency can be achieved by modifying the motion and travel characteristics of the connecting rods of an internal combustion engine.

The connecting rods in conventional internal combustion engines have composite motion, i.e., the small ends of the connecting rods reciprocate, and the large ends of the connecting rods rotate. The small ends of the connecting rods are connected to the pistons with floating cylindrical pins, called wrist pins. The large ends of the connecting rods, which oppose the small ends of the connecting rods, are typically connected to the crankshaft of a typical conventional internal combustion engine by a crankpin.

The characteristics of the motion of the pistons in a convention internal combustion engine are determined by the motion that the connecting rods and the crankshaft assembly impart to the pistons. The motion of the connecting rods and the crankshaft assembly, thus, determine the motion characteristics of the pistons.

The motion of the pistons within ninety degrees before and after "Top Dead Center" is different from the motion within ninety degrees before and after "Bottom Dead Center" in most conventional engines. The piston moves substantially more than half the stroke value, when the piston is in the vicinity of Top Dead Center, and the piston moves substantially less than half the stroke value when the piston is within ninety degrees of Bottom Dead Center.

The asymmetry of motion results from the lateral motion of the crankpin when the piston is in the vicinity of Top Dead Center, and the substantially collinear motion of the crankpin with respect to the centerline of the cylinder when the piston is substantially at Bottom Dead Center, and is influenced by the connecting rod length to stroke ratio.

Again, the rod to stroke ratio (R/S) and the location of the crankpin determine the motion characteristics of the piston and, thus, the performance and efficiency of the engine.

The compression ratio of a conventional internal combustion engine is the ratio of the volume of the cylinder's largest capacity to its lowest capacity. In more detail, the piston sweeps through a volume that is called the displacement volume, and the minimum volume occurs when the piston is at Top Dead Center. The maximum volume, then, is the sum of the displacement volume plus the minimum volume. The ratio of the maximum volume to the clearance volume is called the compression ratio, which influences engine performance, power, and efficiency.

Engine performance, power, and efficiency can be improved by modifying the motion and travel characteristics of the pistons of an internal combustion engine.

Engine performance, power, and efficiency can be improved by modifying and/or altering the clearance volume, the swept volume, or both the clearance volume and the swept volume of the pistons within the cylinders and, in particular, by modifying the connecting rod geometry, motion of the crankpin, and/or by modifying motion of the connecting rod. These and other factors of the present invention will be discussed in more detail.

FIGS. 1-12 show an embodiment of the present invention, an opposed piston engine 10 that has a plurality of crank and connecting rod mechanisms 12, constructed in accordance with the present invention, which impart asymmetric motion to opposed pistons 14 within cylinders 16. The opposed pistons 14, which reciprocate within the cylinders 16, and the crank and connecting rod mechanisms 12 are housed within engine block 17. The cylinders 16 have cylinder bores 18, each of which has a cylinder bore centerline 19.

Each of the crank and connecting rod mechanisms 12 has a connecting rod 20 and a pair of gear sets 22, comprising a first gear set 24 and a second gear set 26, which are mirror images of each other.

The pair of gear sets 22 facilitate asymmetric rotary motion to crank end 28 of the connecting rod 20 at crankpin 30 and reciprocating motion to the opposed pistons 14. The crank end 28 of the connecting rod 20 has a crank end hole 31 therethrough.

The first gear set 24 and the second gear set 26 each have a crank gear 32, each of which is pinned to the crankpin 30 at opposing ends of the crankpin 30.

A crank end bearing 33 is mounted in the crank end hole 31 of the connecting rod 20 for receiving the crankpin 30 therethrough, thus, allowing the crankpin 30 to rotate about the crank gear 32 as the connecting rod 20 reciprocates.

The crankpin 30 extends from and between the crank gears 32 of the first gear set 24 and the second gear set 26, through the crank end bearing 33 mounted in the crank end hole 31 at the crank end 28 of the connecting rod 20, which facilitates motion to be transferred from the connecting rod 20 to the crank gears 32 and vice versa.

The first gear set 24 and the second gear set 26 each have a first stationary gear 34. The crank gears 32 of the first gear set 24 and the second gear set 26 mesh with and rotate about the first stationary gears 34 of the first gear set 24 and the second gear set 26.

The crankpin 30 rotates about the first stationary gears 34 and follows the path of a roulette of a centered trochoid about the first stationary gears 34. Consequently, the crank end 28 of the connecting rod 20 at the crankpin 30 rotates about the first stationary gears 34 and follows the path of the roulette of the centered trochoid about the first stationary gears 34.

The crank gears 32 have crankpin holes 36 for receiving the crankpin 30 therethrough and fastening the crankpin 30 thereto, and the crank end 28 of the connecting rod 20 has the crank end hole 31, which has the crank end bearing 33 mounted therein for receiving the crankpin 30 therethrough. The connecting rod 20 drives the crank gear 32 at the crankpin 30.

The connecting rod 20, which is driven by the explosive force imparted to the piston 14 within the cylinder 16, is connected to the piston 14 at wrist pin 40, which provides a bearing 41 for the connecting rod 20 to pivot upon as the piston 14 moves. The connecting rod 20 has a first leg 42, having a first leg length 43, and a second leg 44, having a second leg length 45, which is angularly disposed from the first leg 42 by angle Ø (46).

The first gear set 24 and the second gear set 26 each have a counterbalanced radial arm 47 and a drive shaft 50. Each of the counterbalanced radial arms 47 comprises a radial arm 48 and a counterweight 49, which minimizes vibration. The counterbalanced radial arms 47 are fastened to and mounted on respective ones of the drive shafts 50. The counterbalanced radial arms 47 drive the drive shafts 50 as the counterbalanced radial arms 47 rotate.

Each of the radial arms 48 has an outer radial arm hole 52 having an outer radial arm bearing 53 mounted therein for receiving crank gear shaft 54 therethrough. Each of the crank gears 32 are pinned to a respective one of the crank gear shafts 54.

The outer radial arm bearings 53 allow the crank gears 32 to rotate about the first stationary gears 34 and drive the radial arms 48 about the drive shafts 50 as the crank gears 32 rotate.

Each of the radial arms 48 has a pivot point drive shaft hole 55. Each of the radial arms 48 are pinned to a respective one of the drive shafts 50 at a respective one of the pivot point drive shaft holes 55.

The connecting rod 20 drives the crankpins 30, which drive the crank gears 32 and the crank gear shafts 54 about the first stationary gears 34. The crankpins 30 each follow the path of the roulette of a centered trochoid, as the crank gears 32 are driven about the first stationary gears 34. Consequently, the crank end 28 of the connecting rod 20 at the crankpin 30 rotates about the first stationary gears 34 and follows the path of the roulette of the centered trochoid about the first stationary gears 34.

The crank gear shafts 54 drive the radial arms 48, as the crank gears 32 rotate about the first stationary gears 34. The radial arms 48, which are driven by the crank gear shafts 54, drive the drive shafts 50 as the crank gears 32 rotate about the first stationary gears 34.

The first gear set 24 and the second gear set 26 each have a crankshaft driven gear 56 and a second stationary gear 57. The crank gears 32 and the crankshaft driven gears 56 are pinned to respective ones of the crank gear shafts 54 at opposing ends of the crank gear shafts 54.

The first stationary gear 34 and the second stationary gear 57 of the first gear set 24 and the second gear set 26 oppose one another, and each have a first stationary gear bearing 58 and a second stationary gear bearing 59, respectively, for rotatably receiving the drive shafts 50 therethrough. Each of the radial arms 48 are pinned to a respective one of the drive shafts 50 between the first stationary gear 34 and the second stationary gear 57. The drive shafts 50 each have flanges or lips at opposing ends of the drive shafts 50 to prevent the drive shafts 50 from moving laterally and to prevent the first stationary gears 34 from moving laterally or separating from the drive shafts 50.

The crank gears 32 drive the crankshaft driven gears 56 via the crank gear shafts 54. The crank gears 32 rotate about the first stationary gears 34, and the crankshaft driven gears 54 rotate about the second stationary gears 57, the crankpins 30 each following substantially the same path of the roulette of a centered trochoid. Consequently, the crank end 28 of the connecting rod 20 at the crankpin 30 rotates about the first stationary gears 34 and follows the path of the roulette of the centered trochoid about the first stationary gears 34.

The outer radial arm bearing 53 allows the crank gears 32 and the crankshaft driven gears 56 to rotate about the crank gear shafts 54, as the crank gears 32 and the crankshaft driven gears 56 rotate about the first stationary gears 34 and the second stationary gears 57.

The crank gears 32 drive the crankshaft driven gears 56 via the crank gear shafts 54 substantially in unison.

The crank gears 32 and the crankshaft driven gears 56 drive the counterbalanced radial arms 47, which drive the drive shafts 50, as the counterbalanced radial arms 47 rotate.

The radial arms 48 of the counterbalanced radial arms 47, which are fastened to and mounted on the drive shafts 50, are driven by the motion of the crank gears 32 about the first stationary gears 34 and the second stationary gears 55 and drive the drive shafts 50.

The crank gears 32 and the crankshaft driven gears 56 have substantially the same trochoidal motion about the first stationary gears 34 and the second stationary gears 57, respectively. Performance of the opposed piston engine 10 may be controlled by controlling the centered trochoidal motion of the crankpins 30, and consequently the centered trochoidal motion of the crank end 28 of the connecting rod 20 by:

adjusting the distance of the crankpin 30 from the centers of the crank gears 32 relative to the radii of the crank gears 32 and/or;

adjusting the diameters of the crank gears 32 relative to the diameters of the first stationary gears 34;

each of which adjusts trochoidal motion of the crank end 28 of the connecting rod 20 and the asymmetric motion of the connecting rod 20 and performance of the crank and connecting rod mechanisms 12 and the performance of the opposed piston engine 10.

It should be noted that pitch circle diameter is used to define the diameter of a gear, which by pure rolling action would produce the same motion as the toothed gear wheel. Pitch circle is the imaginary circle on the gear about which it may be supposed to roll without slipping with pitch circle of another gear. The point of contact of two pitch circle becomes the pitch point.

The connecting rod 20 is preferably angularly shaped, although a conventional connecting rod shape may be used. The angle Ø (46) is typically within ninety degrees to one hundred eighty degrees, but may be any other suitable angle. When the angle θ (46), between the first leg 42 and the second leg 44 of the connecting rod 20, is one hundred eighty degrees, the connecting rod 20 approaches that of a conventional connecting rod. Performance of the opposed piston engine 10 may be controlled further by controlling the angle Ø (46) between the first leg 42 and the second leg 44 of the connecting rod 20 and/or controlling the length of the first leg 42 relative to the length of the second leg 44 of the connecting rod 20.

Thus, performance of the opposed piston engine 10 may be controlled by:

adjusting the distance of the crankpin 30 from the centers of the crank gears 32 relative to the radii of the crank gears 32 and/or;

adjusting the diameters of the crank gears 32 relative to the diameters of the first stationary gears 34; and/or controlling the angle Ø (46) between the first leg 42 and the second leg 44 of the connecting rod 20; and/or controlling the length of the first leg 42 relative to the length of the second leg 44 of the connecting rod 20.

The second stationary gears 57 are fastened to and supported by support members 60 or other suitable supports with fasteners 61.

The first gear set 24 and the second gear set 26 each have a drive shaft gear 62 mounted on a respective one of the drive shafts 50, each of the drive shaft gears 62 being driven by a respective one of the drive shafts 50, and an output gear 63, each of the output gears 63 being driven by a respective one of the drive shaft gears 62.

The opposed piston engine 10 has an output shaft 64, and the support members 60 have holes 65 for receiving the output shaft 64 therethrough. The output gears 63, which are driven by the drive shaft gears 62, drive the output shaft 64.

The engine block 17 has bearings 66 for receiving the drive shafts 50 therethrough and bearings 67 for receiving the output shaft 64 therethrough, thus, allowing the drive shafts 50 and the output shaft 64 to rotate, as the connecting rod 20 reciprocates. The drive shafts 50 and the output shaft 64 each have flanges or lips at opposing ends of the drive shafts 50 and at opposing ends of the output shaft 64 to prevent the drive shafts 50 and the output shaft 64 from moving laterally or inadvertently out of the engine block 17.

The opposed piston engine 10 has improved performance, power, and efficiency, based upon enhancements to the motion characteristics imparted to the pistons 14 by the crank and connecting rod mechanisms 12 of the opposed piston engine 10.

Although the present invention has been described in considerable detail with reference to certain preferred versions thereof, other versions are possible. Therefore, the spirit and scope of the appended claims should not be limited to the description of the preferred versions contained herein.

What is claimed is:

1. A crank and connecting rod mechanism for use in an opposed piston engine, comprising opposed pistons, which reciprocate within opposed cylinders, each having a cylinder bore, comprising:

opposed connecting rods, each connecting rod of said opposed connecting rods having:

a first leg and a second leg angularly disposed from one another, said first leg having a piston end, each piston of said opposed pistons pivotally connected to a said piston end, said second leg having a crank end;

opposed pairs of gear sets, each pair of gear sets of said opposed pairs of gear sets comprising a first gear set and a second gear set, which are mirror images of each other, said first gear set and said second gear set each comprising:

a crankpin, said crank end of said second leg pivotally connected to said crankpin;

a crank gear, said crankpin extending between said crank gear of said first gear set and said crank gear of said second gear set;

a crank gear shaft, said crank gear rotatably mounted on said crank gear shaft, said crankpin located between the centerline of said crank gear shaft and the radius of the pitch circle of said crank gear;

a stationary gear, said crank gear meshing with said stationary gear, said crank end of said connecting rod driving said crankpin, which drives said crank gear and said crank gear shaft about said stationary gear;

said crank pin and said crank end rotating about said stationary gear and following the path of a roulette of a centered trochoid about said stationary gear.

2. The crank and connecting rod mechanism according to claim 1, wherein:

said first gear set and said second gear set each further comprises:

a counterbalanced radial arm driven by said crank gear shaft, an output gear set driven by said counterbalanced radial arm;

said each pair of gear sets of said opposed pairs of gear sets further comprises:

an output shaft driven in tandem by each said output gear set.

3. The crank and connecting rod mechanism according to claim 1, wherein said path of said roulette of said centered trochoid is determined by:

the distance of said crankpin from said centerline of said crank gear shaft relative to said radius of said pitch circle of said crank gear.

4. The crank and connecting rod mechanism according to claim 1, wherein said path of said roulette of said centered trochoid is determined by:

the crank gear diameter of said crank gear relative to the stationary gear diameter of said stationary gear.

5. The crank and connecting rod mechanism according to claim 1, wherein motion of said crank end of said connecting rod is determined by:

the angle between said first leg and said second leg of said connecting rod.

6. The crank and connecting rod mechanism according to claim 1, wherein motion of said crank end of said connecting rod is determined by:

the first leg length of said first leg relative to the second length of said second leg of said connecting rod.

7. A crank and connecting rod mechanism for use in an internal combustion engine, comprising a plurality of pistons, which reciprocate within a plurality of cylinders, each having a cylinder bore, comprising:

a plurality of connecting rods, each connecting rod of said plurality of connecting rods having a piston end and a crank end, each piston of said plurality of pistons pivotally connected to a said piston end;

a plurality of pairs of gear sets, each pair of gear sets of said plurality of pairs of gear sets comprising a first gear set and a second gear set, which are mirror images of each other, said first gear set and said second gear set each comprising:

a crankpin, said crank end of said connecting rod pivotally connected to said crankpin;

a crank gear, said crankpin extending between said crank gear of said first gear set and said crank gear of said second gear set;

a crank gear shaft, said crank gear rotatably mounted on said crank gear shaft, said crankpin located between the centerline of said crank gear shaft and the radius of the pitch circle of said crank gear;

a stationary gear, said crank gear meshing with said stationary gear, said crank end of said connecting rod driving said crankpin, which drives said crank gear and said crank gear shaft about said stationary gear, said crank pin and said crank end rotating about said stationary gear and following the path of a roulette of a centered trochoid about said stationary gear.

8. The crank and connecting rod mechanism according to claim 7, wherein:

said first gear set and said second gear set each further comprises:

a counterbalanced radial arm driven by said crank gear shaft, an output gear set driven by said counterbalanced radial arm;

said each pair of gear sets of said plurality of pairs of gear sets further comprises:

an output shaft driven in tandem by each said output gear set.

9. The crank and connecting rod mechanism according to claim 7, wherein said path of said roulette of said centered trochoid is determined by:

the distance of said crankpin from said centerline of said crank gear shaft relative to said radius of said pitch circle of said crank gear.

10. The crank and connecting rod mechanism according to claim 7, wherein said path of said roulette of said centered trochoid is determined by:

the crank gear diameter of said crank gear relative to the stationary gear diameter of said stationary gear.

11. The crank and connecting rod mechanism according to claim 7, wherein:

each said connecting rod of said plurality of connecting rods has a first leg and a second leg angularly disposed from one another.

12. The crank and connecting rod mechanism according to claim 11, wherein motion of said crank end of said connecting rod is determined by:

the angle between said first leg and said second leg of said connecting rod.

13. The crank and connecting rod mechanism according to claim 11, wherein motion of said crank end of said connecting rod is determined by:

the first leg length of said first leg relative to the second length of said second leg of said connecting rod.

14. A crank and connecting rod mechanism for use in an internal combustion engine, comprising at least one piston, which reciprocates within at least one cylinder having a cylinder bore, comprising:

at least one connecting rod having a piston end and a crank end, said piston end pivotally connected to said at least one piston;

at least one pair of gear sets, said at least one pair of gear sets comprising a first gear set and a second gear set, which are mirror images of each other, said first gear set and said second gear set each comprising:

a crankpin, said crank end of said at least one connecting rod pivotally connected to said crankpin;

a crank gear, said crankpin extending between said crank gear of said first gear set and said crank gear of said second gear set;

a crank gear shaft, said crank gear rotatably mounted on said crank gear shaft, said crankpin located between the centerline of said crank gear shaft and the radius of the pitch circle of said crank gear;

a stationary gear, said crank gear meshing with said stationary gear, said crank end of said at least one connecting rod driving said crankpin, which drives said crank gear and said crank gear shaft about said stationary gear, said crank pin and said crank end rotating about said stationary gear and following the path of a roulette of a centered trochoid about said stationary gear.

15. The crank and connecting rod mechanism according to claim 14, wherein:

said first gear set and said second gear set each further comprises:

a counterbalanced radial arm driven by said crank gear shaft, an output gear set driven by said counterbalanced radial arm;

said at least one pair of gear sets further comprises:

an output shaft driven in tandem by each said output gear set.

16. The crank and connecting rod mechanism according to claim 14, wherein said path of said roulette of said centered trochoid is determined by:

the distance of said crankpin from said centerline of said crank gear shaft relative to said radius of said pitch circle of said crank gear.

17. The crank and connecting rod mechanism according to claim 14, wherein said path of said roulette of said centered trochoid is determined by:

the crank gear diameter of said crank gear relative to the stationary gear diameter of said stationary gear.

18. The crank and connecting rod mechanism according to claim 16, wherein said path of said roulette of said centered trochoid is further determined by:

the crank gear diameter of said crank gear relative to the stationary gear diameter of said stationary gear.

19. The crank and connecting rod mechanism according to claim 14, wherein:

each said at least one connecting rod has a first leg and a second leg angularly disposed from one another.

20. The crank and connecting rod mechanism according to claim 19, wherein motion of said crank end of said at least one connecting rod is determined by:

the angle between said first leg and said second leg of said at least one connecting rod.

21. The crank and connecting rod mechanism according to claim 19, wherein motion of said crank end of said at least one connecting rod is determined by the first leg length of said first leg relative to the second length of said second leg of said at least one connecting rod.

22. The crank and connecting rod mechanism according to claim 20, wherein:

said motion of said crank end of said at least one connecting rod is further determined by:

the distance of said crankpin from said centerline of said crank gear shaft relative to said radius of said pitch circle of said crank gear.

23. The crank and connecting rod mechanism according to claim 20, wherein:

said motion of said crank end of said at least one connecting rod is further determined by:

the crank gear diameter of said crank gear relative to the stationary gear diameter of said stationary gear.

24. The crank and connecting rod mechanism according to claim 22, wherein:

said motion of said crank end of said at least one connecting rod is further determined by:

the crank gear diameter of said crank gear relative to the stationary gear diameter of said stationary gear.

* * * * *